US006006687A

United States Patent [19]

Hillman et al.

[11] Patent Number: 6,006,687

[45] Date of Patent: Dec. 28, 1999

[54] MODULAR FLOATING BOAT LIFT

[75] Inventors: Jeffrey M. Hillman, La Crescent; Clifton D. Vierus, Minnesota City, both of Minn.

[73] Assignee: Marine Floats, Inc., Winona, Minn.

[21] Appl. No.: 09/010,089

[22] Filed: Jan. 21, 1998

[51] Int. Cl.[6] ..... B63C 1/02

[52] U.S. Cl. ..... 114/46; 114/45

[58] Field of Search ..... 114/256, 258, 114/263, 259, 44, 45, 46, 47

[56] References Cited

U.S. PATENT DOCUMENTS

| | | | |
|---|---|---|---|
| 1,300,954 | 4/1919 | Gray | 114/46 |
| 2,325,607 | 8/1943 | Harris | 114/46 |
| 2,774,322 | 12/1956 | Harris | 114/46 |
| 3,659,546 | 5/1972 | Miklos | 114/235 |
| 4,510,877 | 4/1985 | Bloxham | 114/45 |
| 5,249,545 | 10/1993 | Gettman | 114/259 |
| 5,281,055 | 1/1994 | Neitzke et al. | 405/219 |

*Primary Examiner*—D. Glenn Dayoan
*Assistant Examiner*—Patrick Muldoon
*Attorney, Agent, or Firm*—Fredrikson & Byron, P.A.

[57] ABSTRACT

A floating boat lift capable of accommodating a wide variety of V-hulled boats. The boat lift is comprised of docking members, a bow stop that protects the hull of the boat, a stern segment and at least one intermediate segment. The stern segment and intermediate segment contain a channel with rollers that assist in conveying the boat over the boat lift and supporting the boat when docked. The rollers have different height configurations and can be positioned in different trays in the channel so that they can be used with boats that have different dead rise angles.

16 Claims, 9 Drawing Sheets

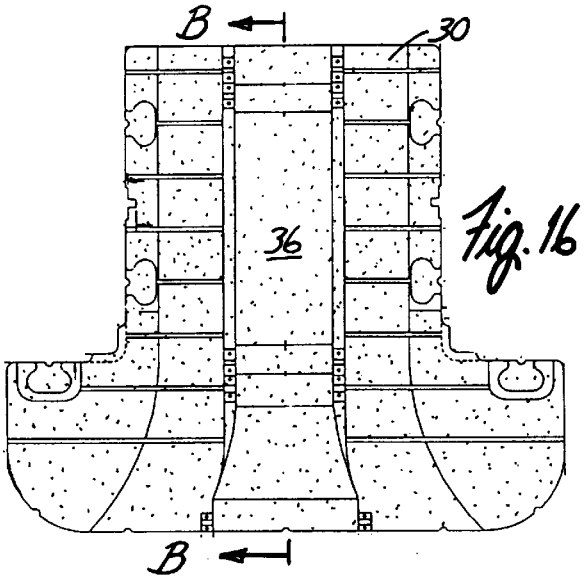
Fig. 16
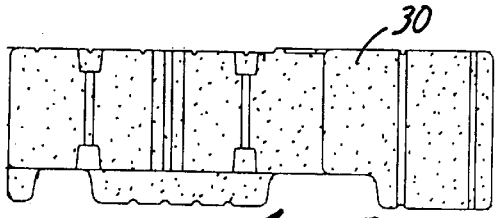
Fig. 18
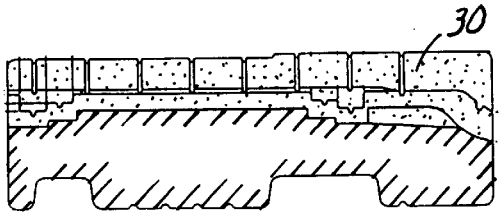
Fig. 19
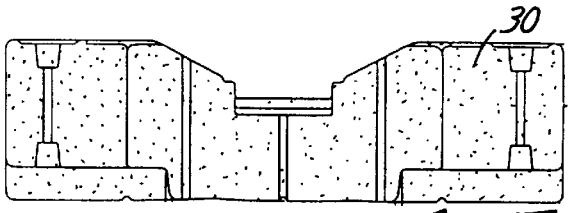
Fig. 17
Fig. 15
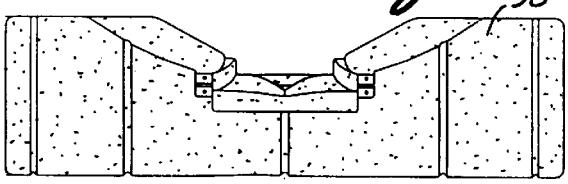

MODULAR FLOATING BOAT LIFT

FIELD OF THE INVENTION

The present invention relates generally to a system of securing a boat to a dock so that the boat is not resting in the water when not in use. More particular, the invention relates to a floating lift comprised of modular segments that allows for v-hulled boats to be easily exited from the water, conveyed along the lift and cradled onto a floating dock. The boat can be positioned onto the lift in a variety of manners, including driving the boat directly up and onto the lift or using a winch to pull the boat onto the lift.

BACKGROUND OF THE INVENTION

Recreational and commercial boating is a popular activity. While some boaters transport their boats to the water each time they are to be used, the majority of boats are docked or otherwise stored on the water when they are not in use. This allows the boat to be in a convenient location that is easily accessed by the boat owner or user. Such boats are typically secured to a dock or other fixture on the water.

A boat that rests in the water when not in use, however, can suffer from several detriments. For example, floating or partially submerged debris can impact and damage the hull or motor. Another potential hazard is seaweed or water grasses that can become entwined in the prop. Additionally, algae and other plant or animal life can start to build up on a the portions of the boat that remained submerged for extended periods. Thus, while it is convenient to keep a boat in the water while not in use, doing so may cause the boat to become unsightly, difficult to use or even damaged.

One method of avoiding the problems associated with allowing a boat to sit in water when not in use while still keeping the boat near the water for ease of use is to use a boat lift that removes the boat from the water. Common boat lifts are typically attached to the dock and store the boat above the water. When the boat is to be used, the operator lowers the lift so that the boat is placed back in the water.

Many existing boat lifts, however, suffer from severe disadvantages. For example, one common drawback of many boat lifts is that they are difficult to operate. Many boat lifts employ a mechanism that supports and physically lifts the boat out of the water. One common example of such an arrangement consists of a platform that is initially submerged in the water. When the boat is to be docked, the boat is maneuvered so that it is positioned over the platform. The platform is then raised, typically through the use of a crank or wheel, by the operator so that it contacts the base of the boat. The platform is then raised further so that it and the boat are situated out of, and above, the water.

These types of boat lifts, however, can be quite difficult to use. For instance, the boat must be precisely positioned above the platform. This maneuver can be especially difficult on a windy day or when the water is choppy. Additionally, even with the aid of a mechanical device, such as a crank, raising the platform with the boat secured to it can require a lot of effort and be time consuming.

A further problem with many existing boat lifts is that they do not properly secure the boat to the platform. In order to avoid damage to the hull, the boat should be cradled by the platform. The platform should also not allow the boat to sway too much so that an operator and passengers can safely enter and exit the boat. Many boat lifts, however, do not meet these criteria or do so only through the use of complicated contraptions.

Another disadvantage of many existing boat lifts is that they have limited versatility. The configuration of many boat lifts limits their application to only certain types of boat hulls or to certain types of motors on the boats. Thus, a particular boat lift may only be appropriate for a limited number of boats.

For example, the platform type boat lift previously described can only support boats of a certain length and weight. An owner of a boat that exceeds the length or weight criteria of the boat lift will not be able to use the platform to dock the boat. Thus, an owner of multiple boats of various sizes, such as a resort, will need to have several different boat lifts available or will otherwise be unable to dock all of the boats on a boat lift.

A further disadvantage of traditional boat lifts is that there are limited environments in which they can be used. Traditional boat lifts are commonly secured by attaching them to anchors such as pilings, pipes, or deadweights. These anchors will be fully or partially submerged in the water and are either driven into the water's bed or weighted and rest on the bed itself.

Such an arrangement, however, severely limits the conditions under which the boat lift can be used. For example, existing boat lifts would not be appropriate for bodies of water in which broad water level changes occur or in which the water's bed is soft.

Another drawback of traditional boat lifts is that they can be costly to maintain. Many boat lifts have sections that are partially or entirely submerged in water. Furthermore, as previously mentioned, many boat lifts are attached to anchors that rest on, or are driven into, the water's bed. The continual exposure of these parts to the action of the water, currents, waves, weather conditions and floating debris can cause them to deteriorate rapidly. Thus, the lifts require frequent maintenance in order to prolong the life of the boat life. Such maintenance, however, besides being inconvenient, can also be costly, as the portions of the boat lift requiring the maintenance will generally be difficult to access.

Additionally, many boat lifts must be constructed and positioned in the water with the assistance of machinery. Besides being difficult to construct, many bodies of water lack sufficient access for such machinery, thereby making installation of the boat lift difficult or impossible.

A need exists, therefore, for a boat lift that is durable, easy to install, simple to use and versatile enough so that it can be used with a variety of boat sizes and in a variety of locations. The present invention accomplishes these goals through the use of a unique modular floating boat lift. The boat lift is comprised of a bow sections, a stern section and an intermediate section. Additional intermediate sections can be used to allow the boat lift to accommodate various sizes of boats. The boat lift also uses rollers to aid in maneuvering the boat onto and over the sections. The construction of the boat lift makes it durable, maintenance free and convenient to use.

SUMMARY OF THE INVENTION

The present invention relates to a floating boat lift for supporting a boat at a dock so that the boat rests our of the water. The boat lift is comprised of several parts, including docking members that provide the dock to which the boat lift is attached, a bow stop that protects the boat's bow when it is on the boat lift, a stern segment that assists in the initial entry of the boat onto the boat lift as well as the exiting of the boat from the boat lift, and intermediate segments that assist in conveying the boat along the boat lift and which also support the midsection of the boat when the boat is resting on the boat lift.

Several docking members can be used to support the boat lift. The docking members are arranged so that the boat lift rests between two docking members. The docking members include couplers and sockets for securely attaching the boat lift.

The bow stop includes a receiving end that is configured to accept the bow of the boat as it rests upon the boat lift. The bow stop also protects the bow of the boat and prevents the boat from over shooting the end of the boat lift. The bow stop also includes a winch. The strap of the winch can be attached to the boat and the winch used to draw the hull of the boat onto and over the boat lift.

The stern segment is also secured between the docking members and is located at the end of the boat lift opposite the bow stop. The stern segment includes a channel for guiding the boat onto, and off of, the boat lift. The channel widens and slopes downward towards the water at the far end, thereby aiding in the entry of the hull of the boat onto the boat lift as well as the egress of the boat from the boat lift.

Several intermediate segments can be used with the boat lift depending upon the size of the boat to be docked. Like the bow stop and stern segment, the intermediate segments are also secured between the docking members. The intermediate segments are positioned between the bow stop and the stern segment. Each intermediate segment includes a channel, similar to the one found on the stern segment, for assisting in the conveyance of the boat hull over the boat lift both towards, as well as away from, the bow stop.

The stern segment and intermediate segments contain rollers that are located across the channels. The rollers assist in the movement of the hull of the boat through the channels so that the boat can travel easily over the boat lift. The stern segment contains multiple rollers that aid in aligning and guiding the hull of the boat into proper position on the boat lift.

Both the docking members and the segments making up the boat lift are constructed of molded polyethylene. This fabrication allows the dock and boat lift to float on the water's surface and provides for a rugged and virtually maintenance free construction.

The boat lift can be used with a wide variety of V-hulled boats. A boat can be docked on the boat lift in several fashions. One common method of docking a boat on the boat lift is to drive the boat until it is lined up with the stern segment of the boat lift. The boat can then be driven directly onto the boat lift so that the boat's bow is positioned near the bow stop. The rollers on the stern segment and intermediate segments assist the movement of the hull of the boat across the boat lift.

An alternate method of docking the boat is to hook it up to the winch on the bow stop after the boat is lined up with the boat lift. The winch is then used to pull the boat onto and over the boat lift.

The boat can be launched in a similar fashion. The rollers on the stern segment and intermediate segments allow one or two people to push the boat along the boat lift away from the bow stop and into the water.

BRIEF DESCRIPTION OF THE DRAWINGS

FIG. 15 is a front view of the stern segment of the invention.

FIG. 16 is a top view of the stern segment of the invention.

FIG. 17 is a back view of the stern segment of the invention.

FIG. 18 is a side view of the stern segment of the invention.

FIG. 19 is a cross sectional view of the stern segment of the invention taken along line B—B.

DETAILED DESCRIPTION OF THE INVENTION

Figure 1:
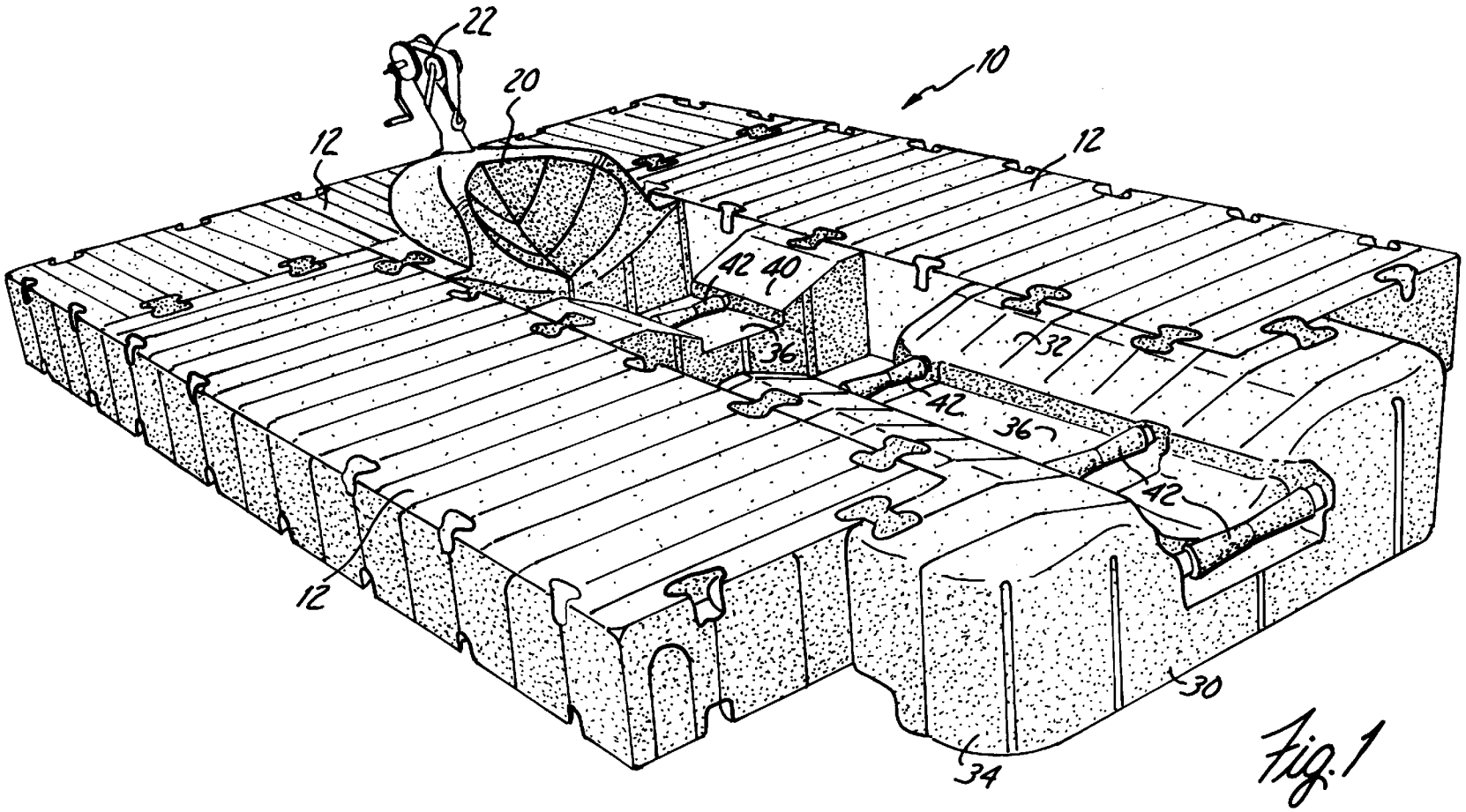
FIG. 1 is a perspective view of the invention.

As can be seen in FIGS. 1–19, the present invention concerns a boat lift 10. The boat lift 10 is suitable for docking a wide variety of boats so that the boat hull resides out of the water. The boat lift 10 is particularly well suited for docking V-hulled boats, including Jet-boats, bass boats, outboard and I/O runabouts.

The boat lift 10 is extremely flexible in its applications as well as in its construction and design. Although the boat lift is appropriate for use with a wide variety of water craft, references herein may frequently be made to specific types of boats or their hulls. Such references are for illustrative purposes only and should not be viewed as limiting the application of the boat lift 10 in any manner.

The boat lift 10 is generally comprised of docking members 12, a bow stop 20, a stern segment 30 and at least one intermediate segment 40. The materials from which these components can be constructed can vary depending upon the desired application and the particular environment in which they will be used. Similarly, although there are advantages to having all of the components constructed from the same or similar material, each or certain of the components could also be constructed of different materials.

As mentioned, the components of the boat lift 10 can be manufactured from a variety of materials. Furthermore, some or all of the individual components of the boat lift 10 could also be manufactured from different materials as compared to each other. It is desirable, however, to have all of the components manufactured in a similar fashion from a similar material. This arrangement leads to certain advantages, including reduced overall manufacturing costs and similar characteristics among the components, such as buoyancy, coefficient of friction and resistance to water contaminants.

In the preferred embodiment, the docking members 12, bow stop 20, stern segment 30 and intermediate segments 40 are all constructed of rotational molded polyethylene with a UV stabilizer. Although the thickness of the polyethylene can vary depending upon the application, the components should desirably have a thickness in the range between 3/16 of an inch and 5/8 of an inch.

Floating dock components formed from molded polyethylene and containing attachment means are disclosed in U.S. Pat. No. 5,281,055 issued to Neitzke et. al, which is herein incorporated by reference.

The individual sections of the boat lift 10 can be designed in a variety of fashions. In the preferred embodiment, the components are generally hollow so as to create a cavity. Within the hollow cavity of the components are desirably elongate struts that stretch from the bottom surface of the component towards the top surface of the component. These struts provide additional structural support for the components as well as prevent sagging of the components when pressure is applied to them.

The struts can be of any suitable formation. In the preferred embodiment, portions of the bottom surface extend upwardly into the interior of the component towards the top surface to form a series of tapered pylons. The struts desirably include pylons with an arcuate top. If desired, the pylons can be connected by slightly taller and wider pylons.

Depending upon the size of the component, multiple, generally parallel, strips of pylons can run along the length of the bottom surface of the component. When the components are positioned on the water, air is trapped within the pylons, thereby assisting in the buoyancy of the component and allowing the component to remain afloat even in the event that it becomes damaged and water begins to enters the cavity.

The overall construction of the components makes the boat lift 10 durable, flexible and resistant to gas, oil, rot, and other contaminants found in a water environment. As mentioned, the boat lift 10 is also very stable in the water and able to withstand various wind and wave effects. Thus, in many settings, the boat lift 10 can remain in the water for a longer portion of the year than other types of boat lifts.

The components of the boat lift 10 also include means for securing the individual components together. In the preferred embodiment, coupler receiving sockets are located around the perimeter of the docking members 12, opposing sides of the bow stop 20 and intermediate segment 40 and the inside edges of the stern segment 30.

In the preferred embodiment, an equal number of sockets are located on both the top and bottom surfaces of the components of the boat lift 10, with each socket on the top surface having a corresponding socket generally vertically below it on the bottom surface. The surfaces can have any appropriate number of sockets with the exact number depending upon such factors as the size and the specific application of the component. The number of sockets on the surface of the docking members 12, in particular will vary. Generally three to six sets of sockets are located along both lengths of the sides of each docking member 12 and two to four sets of sockets are located on both ends of the docking member 12. The sockets are desirably uniformly spaced along all four sides of the docking member 12.

In general, the bow stop 20 and the intermediate segments 40 will each contain one set of sockets on each opposing side. The stern segment 30 will desirably have two sets of sockets along each side of the plug section and one set of sockets along each side of the ramp section, with a set of sockets positioned on opposing sides of the channel running along the stern segment 30.

Coupler grooves desirably run in a generally vertically direction along the side walls of the components of the boat lift 10. The coupler grooves desirably run from a socket on the top surface down to the corresponding socket on the bottom surface. The coupler grooves assist in the attachment of the couplers and also serve to add strength to the side walls.

In the preferred embodiment, the sockets are symmetrical about their lateral axis and open on the end leading to the coupler groove. The sockets are intended to receive the couplers in a locking relationship and are thus, shaped accordingly. While the design of the sockets can vary appropriately, in the preferred embodiment, they are comprised of recesses patterned similarly to a T-shape with rounded edges. The sides of the socket extend beyond the opening of the socket to help secure the anchor of the coupler within.

Connectors are used to attach docking members 12 together, to attach the bow stop 20, intermediate segment 40 and stern segment 30 to the docking members 12, and to attach other devices to the docking members 12. The components of the boat lift 10 are connected together through the use of couplers. Each coupler desirably contains two anchors pieces that are secured together by a tie rod.

The anchors are symmetrical about both their longitudinal and lateral axis and are desirably shaped so that each end can fit snugly into a receiving socket on the components of the boat lift 10. Each end of the anchors desirably flares out into a flange so that the it is wider at its ends than at its middle. The anchors can be constructed of any suitable material and in the preferred embodiment, they are made of rubber. The rubber construction results in an anchor that can be positioned tightly into the sockets with sufficient strength to withstand the torsional stresses exerted upon it when in the socket by the actions of the waves, wind and boats being docked, yet is also flexible enough to be compressed by these forces without losing much of its strength or resiliency. Also in the preferred embodiment, the anchors have the added environmental benefit of being made from recycled tires.

The tie rods act to bridge the anchors together. Any appropriate attachment means can be used, but they should desirably be flexible enough to allow for some movement of the anchors, yet be strong enough to ensure that the anchors remain securely fitted within the sockets on the components of the boat lift 10. Additionally, as the tie rods will frequently come into contact with the water, they should be properly insulated or constructed from a corrosion resistant material so as to avoid accelerated weakening. In the preferred embodiment, stainless steel rods are used for the tie rods.

The anchors can be secured to the tie rods by any suitable attachment means. In the preferred embodiment, a hole is desirably located in the anchors generally at their center and the anchors are secured to the tie rods by inserting the tie rod through the hole and attaching a nut or other appropriate attachment device to it. The length of the tie rod is of a dimension that is desirable slightly shorter than the height of the particular component of the boat lift 10 so that when in position, the anchors are fitted tightly within the sockets securing the coupler in place and prevent undue movement of the component of the boat lift 10.

Figure 20:
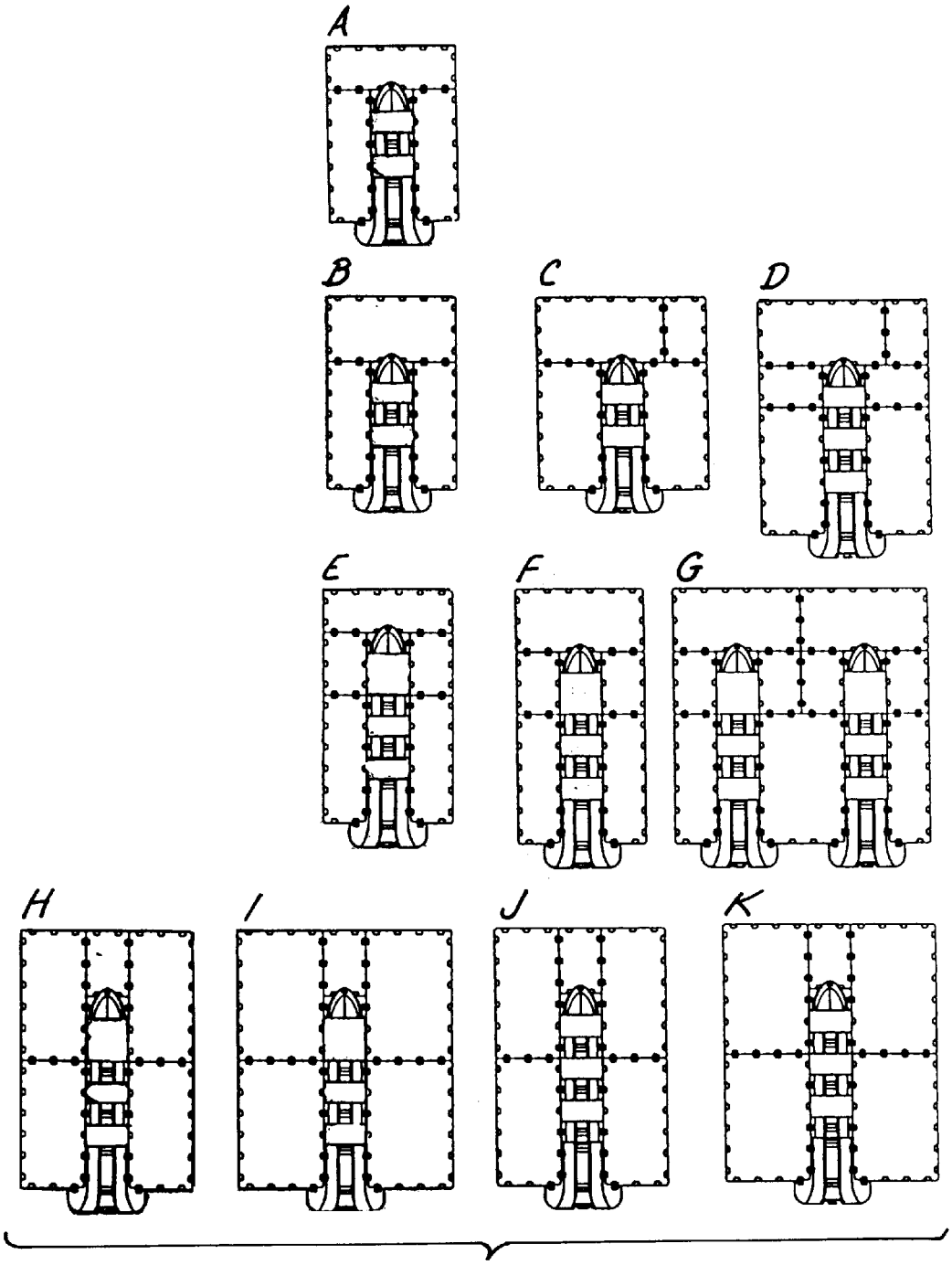
FIG. 20 is a depiction of possible configurations of the invention.

As can be seen in FIGS. 1 and 20, the docking members 12 can be of a variety of configurations. Each docking member 12 is desirably generally rectangular in shape. In the preferred embodiment, four sizes of docking members 12 are available. One docking member 12 is approximately forty inches wide and sixty inches long. The second docking member 12 is approximately forty inches wide and ten feet long. The third docking member 12 is approximately sixty inches wide and ten feet long. The fourth docking member 12 is approximately eighty inches wide and ten feet long. In the preferred embodiment, each docking member 12 is approximately fifteen inches high.

The modular design of the docking members 12 allows multiple units to be secured together to create an unlimited number of sizes and designs. Additionally, in the preferred embodiment, one docking member 12 is used a head piece. The head piece typically is connected to both of the docking members 12 and is positioned so that the bow stop 20 rests adjacent to it.

The bow stop 20 protects the craft's bow both while docked and while the craft is being docked. The configuration of the bow stop 20 can vary. However, in the preferred embodiment, the bow stop 20 is approximately twenty inches long, forty inches wide and fifteen inches high. The bow stop 20 includes sockets so that it can be secured between two docking members 12. The position of the sockets on the bow stop 20 desirably correspond to those located on the docking members 12.

Figure 2:
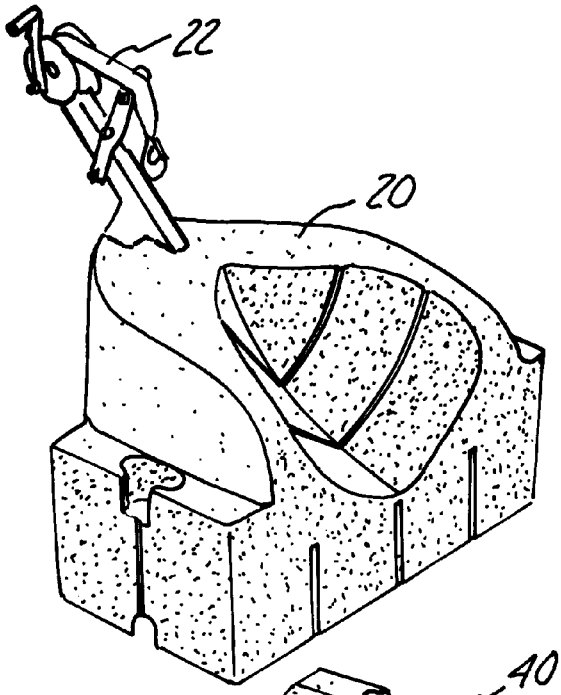
FIG. 2 is a perspective view of the bow stop of the invention.
Figure 11:
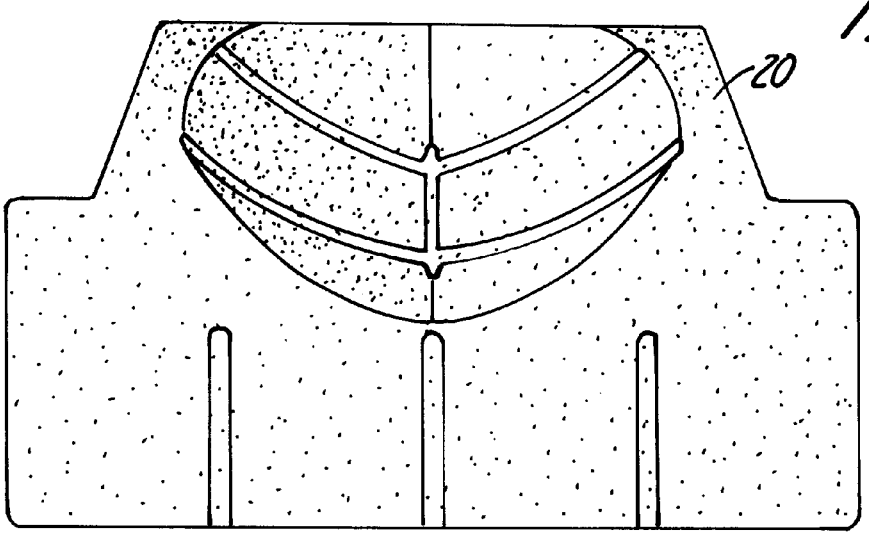
FIG. 11 is a back view of the bow stop of the invention without the winch.

Also in the preferred embodiment, as shown in FIGS. 2 and 11, one end of the bow stop 20 is open to receive the hull of the craft to be docked. This open end is desirably configured with a V-shape recess. This allows the hull of the craft to nest within the bow stop 20 if necessary, thereby preventing the craft from traveling beyond the boat lift 10 and safeguarding the hull of the craft while the craft is docked.

The bow stop 20 also desirably includes means for assisting in the boarding of the craft onto the boat lift 10. Any appropriate means can be used, such as a pulley. In the preferred embodiment, however, a winch 22 is incorporated into the bow stop 20. The winch 22 is positioned on the top portion of the bow stop 20 opposite the V-shaped recess. In this location the winch 22 can effectively assist in the docking of the craft onto the boat lift 10 and is also easily accessible to the craft operator. Any appropriate winch 22 can be used, however, in the preferred embodiment, the winch 22 consists of a Fulton heavy duty winch. The winch includes a strap and hook, or other suitable equipment, for assisting in boarding the craft.

The boat lift 10 includes a stern segment 30 positioned at the rear portion of the boat lift 10. Although the stern segment 30 can be constructed of any appropriate configuration, in the preferred embodiment, it is generally of a T-shape configuration overall with a plug section 32 and a ramp section 34. This design allows for a portion of the stern segment 30 to be positioned between two docking members 12 while a portion rests at the base of the docking members 12. In an alternate embodiment, the stern segment 30 is configured of a portion that overlaps the docking members 12 and a separate intermediate segment 40 positioned between the docking members 12.

The dimensions of the stern segment 30 can vary. In the preferred embodiment, the stern segment 30 is sixty inches long, fifteen inches high and forty inches wide at the plug section 32 and seventy inches wide at the ramp section 34.

As mentioned, the stern segment 30 is desirably configured in a T-shape that is comprised of a plug section 32 and a ramp section 34. The plug section 32 is configured so that it can be positioned between two docking members 12 in a manner similar to the bow stop 20. As such, the width of the plug section 32 approximates that of the width of the bow stop 20. Additionally, the plug section 32 contains sockets for attaching the plug section 32 to the docking members 12. The position of the sockets on the plug section 32 desirably correspond to those located on the docking members 12. In the preferred embodiment, the stern segment 30 is attached to the docking members 12 at a location opposite that of the bow stop 20. Thus, when the bow stop 20 and stern segment 30 are both attached between the docking members 12, the docking members 12 are approximately parallel to each other.

In the preferred embodiment, the plug section 32 of the stern segment 30 extends outwardly beyond the ends of the docking members 12 to form the ramp section 34. The width of the ramp section 34 is desirably greater than that of the plug section 32 so that the ramp section 34 partially extends over the ends of the docking members 12.

The ramp section 34 of the stern segment 30 also desirably contains sockets for further attaching the stern segment 30 to the docking members 12. The position of the sockets on the ramp section 34 correspond to those located on the ends of the docking members 12. Securing the ramp section 34 to the docking members 12 in this way provides additional stability to the boat lift 10, both while in the water and during the boarding of the craft.

The extended width of the ramp section 34 provides a larger target for the craft operator to aim at when boarding the craft. Furthermore, the wide ramp section 34, together with the sloping portion of the channel 36 on the ramp section 34, helps to align and guide the hull of the craft into the appropriate position on the boat lift 10 during boarding of the craft.

The boat lift 10 also includes at least one intermediate segment 40 positioned between the bow stop 20 and the stern segment 30. Each intermediate segment 40 is generally similar in shape and dimensions. While the configuration of the intermediate segment 40 can vary, in the preferred embodiment, it is twenty inches long, forty inches wide and fifteen inches high.

Like the bow stop 20 and stern segment 30, the intermediate segment 40 is secured between two docking members 12. Also like the bow stop 20 and the stern segment 30, the intermediate segment 40 includes sockets for attaching it to the docking members 12. The position of the sockets on the intermediate segment 40 desirably correspond to those located on the docking members 12.

The boat lift 10 is able to accommodate multiple intermediate segments 40. If more than one intermediate segment 40 is desired, the appropriate docking members 12 can be used with the boat lift 10. The number of intermediate segments 40 used for a particular boat lift 10 will primarily depend upon the size of the craft to be docked. The boat lift 10 is able to support crafts of various weights and lengths by varying the number of intermediate segments 40 used as well as the size and configuration of the docking members 12 with the intermediate segments 40.

Running along the lateral length of both the intermediate segment 40 and the stern segment 30 is a channel 36. The channel 36 serves to assist the boarding of the craft onto the boat lift 10 and to aid in the support of the craft once it is docked. The width and depth of the channel 36 can vary, depending upon the particular application desired and the size of the boat lift 10. The channel 36 should be wide enough, however, to sufficiently accommodate and support the craft to be docked. In the preferred embodiment, the width of the channel 36 approximates that of the rollers 42 that are positioned within the channel 36 while the depth of the channel 36 provides the rollers 42 with sufficient space to function.

The channel 36 is desirably open on both ends of both the intermediate segment 40 and the stern segment 30. In the preferred embodiment, the width and depth of the channel 36 is generally uniform over the length of the intermediate segment 40 and plug section 32 of the stern segment 30.

Also in the preferred embodiment, the channel 36 on the stern segment 30 widens as it travels from the plug section 32 across the ramp section 34. The depth of the channel 36 also increases over the rearmost portion of this area, thereby creating an entry point for the craft that slopes down towards the water. The area of the channel 36 on the ramp section 34 between where the channel 36 begins to widen and where the slope begin also desirably contains a V-shaped depression that spans the width of the channel 36.

The wide opening of the ramp section 34 combined with the sloped portion of the channel 36 serves to assist the initial mounting of the craft onto the stern segment 30 when the craft is to boarded by funneling the hull of the craft towards the channel 36 in the stern segment 30. Additionally, the V-shaped depression in the ramp segment 34 further aids in the boarding of the craft by aligning the hull of the craft and directing it towards the portion of the channel 36 on the plug section 32.

As previously stated, a craft is boarded onto the boat lift 10 by transporting the hull of the craft through the channel 36. Although the winch 22 is capable of pulling a wide variety of boats onto the boat lift 10, in many instances, it is desirable to compensate somewhat for the natural resistance of the channel 36 when boarding a craft. In addition to aiding in the boarding of the craft, such compensation also reduces the risk of marring the channel 36 or the hull's finish.

Numerous means of reducing the resistance of the channel 36 are available. For example, a lubricant could be applied to the channel 36. However, such an approach is inconvenient as well as potentially detrimental to the environment. An alternate approach is to use a mechanical device, such as a belt, in association with the channel 36 to assist in the movement of the craft over the boat lift 10. Such a device moves with the hull of the craft in relation to the channel 36.

Figure 3:
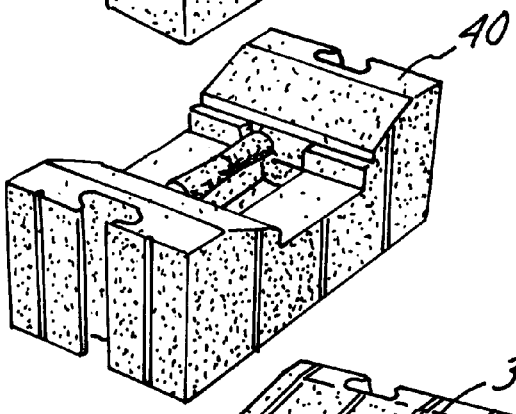
FIG. 3 is a perspective view of an intermediate segment of the invention.
Figure 4:
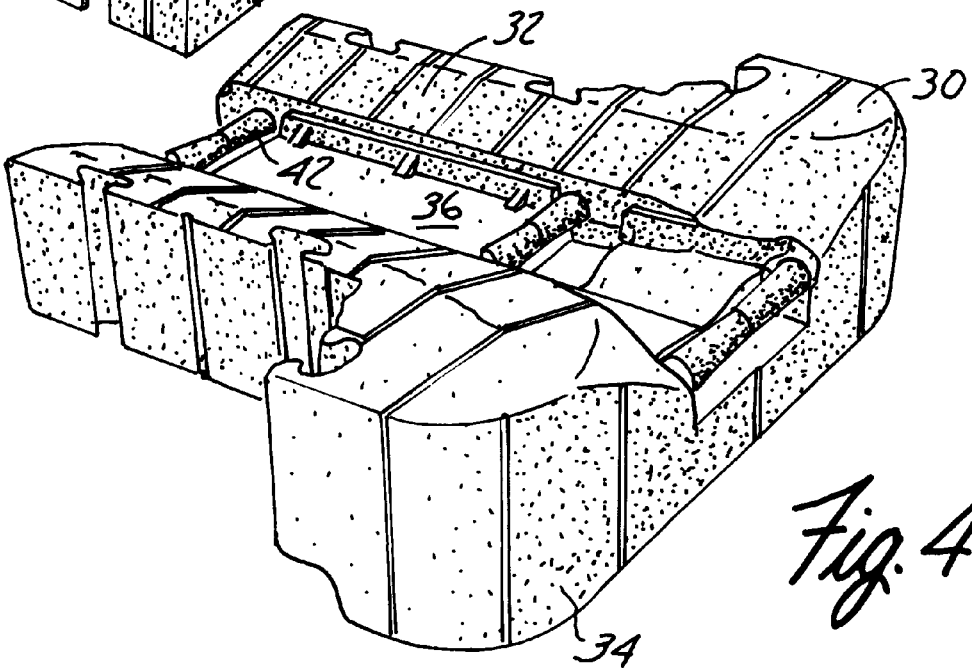
FIG. 4 is a perspective view of the stern segment of the invention.
Figure 5:
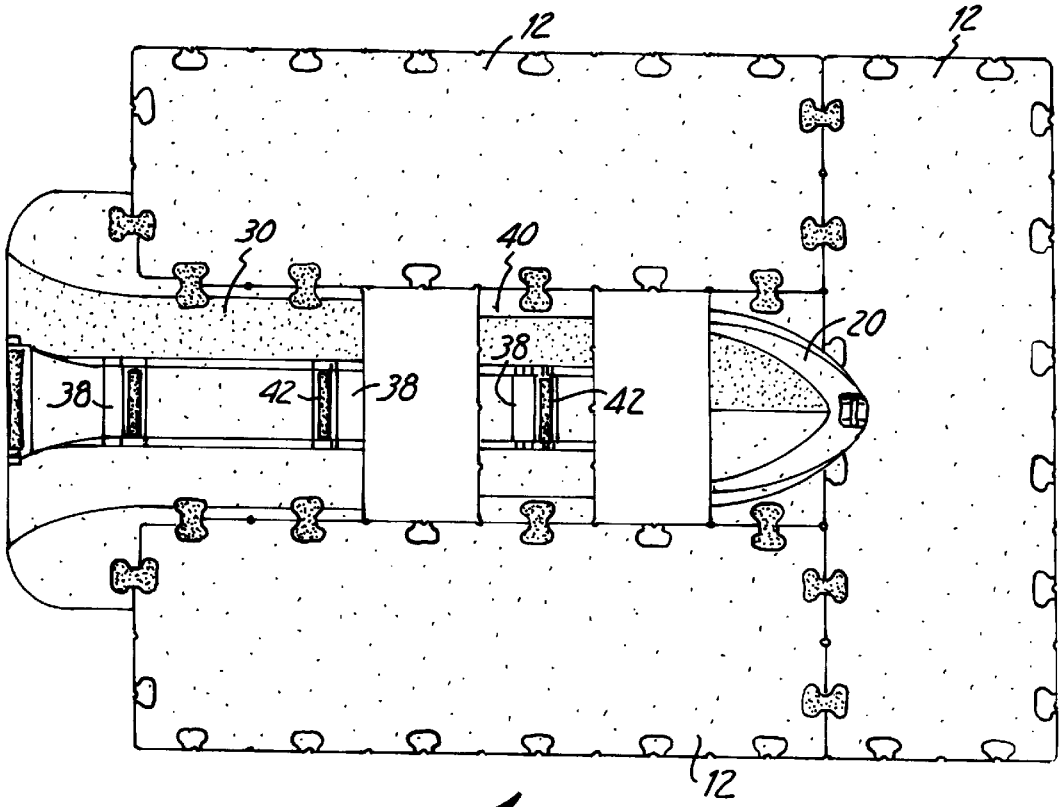
FIG. 5 is a top view of the invention.
Figure 6:
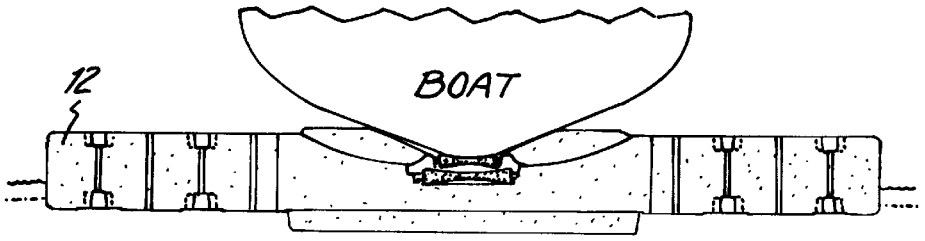
FIG. 6 is an end view of the invention showing the position of a boat.
Figure 7:
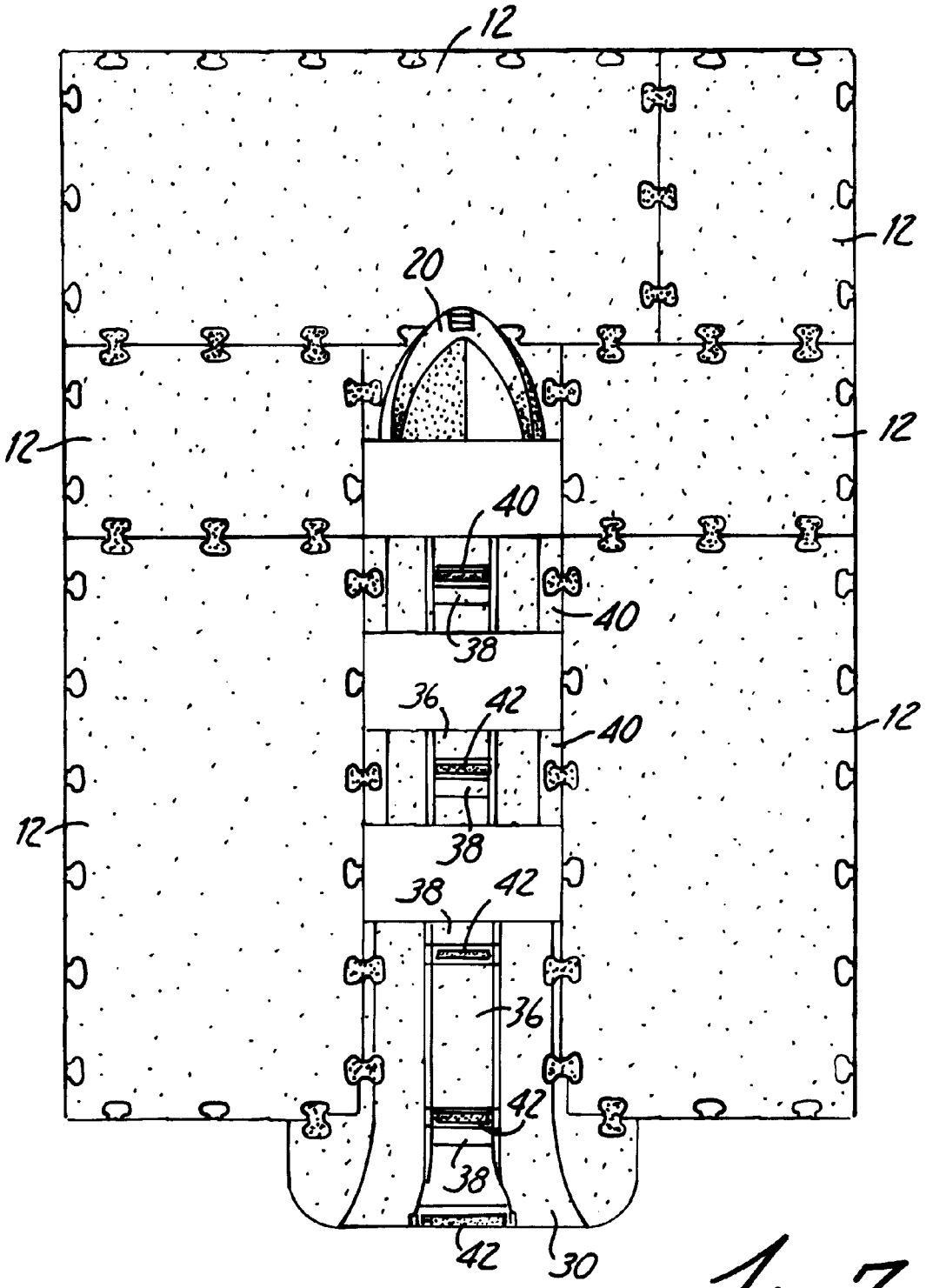
FIG. 7 is a top view of an alternate embodiment of the invention.
Figure 8:
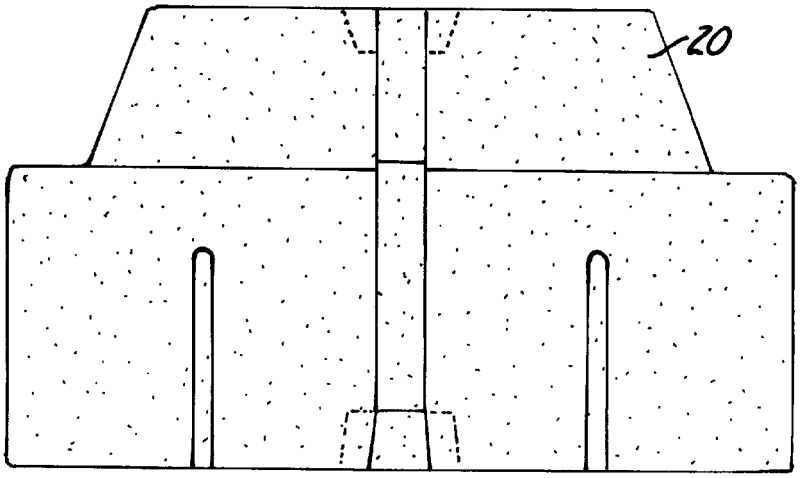
FIG. 8 is a front view of the bow stop of the invention without the winch.
Figure 9:
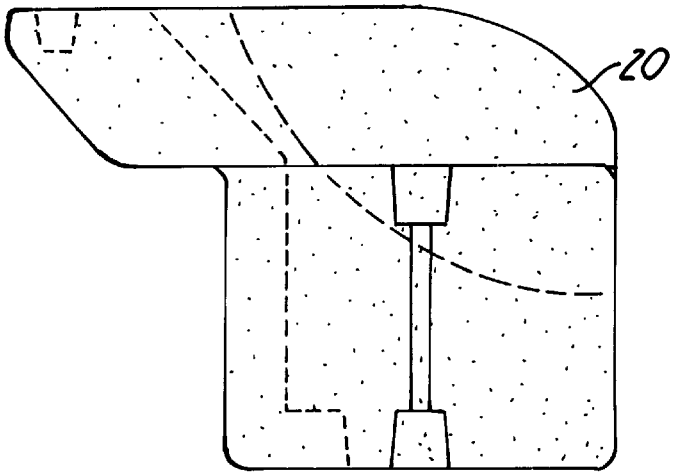
FIG. 9 is a side view of the bow stop of the invention without the winch.
Figure 10:
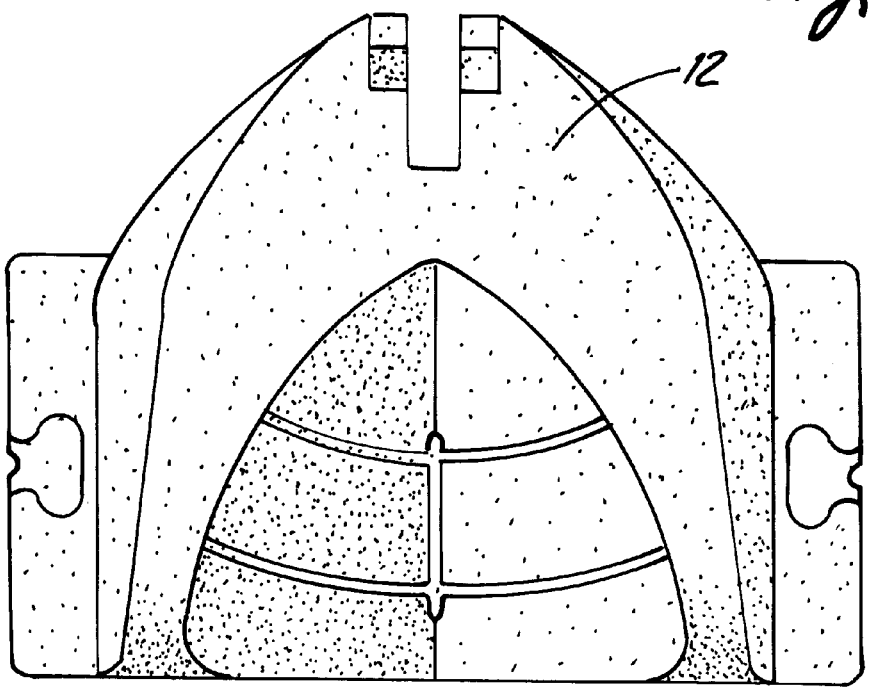
FIG. 10 is a top view of the bow stop of the invention without the winch.

As can be seen in FIGS. 1, 3 and 4, rollers 42 are used to help convey the craft over the boat lift 10. Although rollers 42 could be used with either the stern segment 30 or intermediate segment 40, separately, in the preferred embodiment, rollers are incorporated into both the stern segment 30 and intermediate segment 40.

The number of rollers 42 used on the stern segment 30 and intermediate segment 40 can vary and will depend primarily upon the length of the stern segment 30 and intermediate segment 40. In the preferred embodiment, one roller 42 is located on the intermediate segment 40 and three rollers 42 are located on the stern segment 30.

The position of the rollers 42 on the intermediate segment 40 and stern segment 30 can also vary. The roller 42 incorporated into the intermediate segment 40 desirably spans the entire width of the channel 36. Additionally, the roller 42 is desirably located approximately at the center of the intermediate segment 40 in order to provide proper balance of the craft when the craft is resting upon the intermediate segment 40.

As shown in FIG. 4, the rollers 42 also desirably span the entire width of the channel 36. Additionally, in the preferred embodiment, one roller 42 is located at the end of the plug section 32, one roller 42 is located just before the V-shaped depression on the ramp section 34 and one roller 42 is located on the sloped area of the ramp section 34. Thus, although not required to be, this last roller 42 located on the sloped area of the ramp section 34 is longer than the other rollers 42.

The rollers 42 can be constructed of any suitable materials and design. The rollers 42 must be able to freely rotate under the weight of a craft and should desirably resist corrosion and the development of flat spots and should not mar the finish of the craft's hull. In the preferred embodiment, Stoltz Super Rollers™ are used.

The rollers 42 can be attached to the stern segment 30 and intermediate segment 40 through the use of any appropriate means, such as screws or rivets. The rollers 42 should be attached to the boat lift 10 so that they will not work themselves free under the stresses of boarding the craft. In the preferred embodiment, the channels 36 on the stern segment 30 and intermediate segment 40 include trays 38. The rollers 42 reside within the trays 38 so that they span the channels 36. Each tray 38 contains receptacles for receiving the desired attachment means for the rollers 42.

If desired, the rollers 42 can be secured across the channel 36 so that height of each roller 42 is constant. For example, the roller 42 located on the sloped region of the ramp section 34 will typically function to guide the hull of the craft onto the boat lift 10 and, because it is positioned at a substantially lower depth than the remaining rollers 42 on the stern segment 30, it will generally not support the hull of the craft when the craft is docked. Thus, this roller 42 can generally be fixed across the channel 36 so that its height does not change.

In the preferred embodiment, however, at least some of the rollers 42 are adjustable in height. This variation in height can be achieved in a variety of ways. For the present invention, two features, one related to the rollers 42 and one related to the channel 36, allow the rollers 42 to achieve multiple heights. First, each roller 42 possess a configuration that allows it to be secured within a tray 38 in four different settings. The height of the roller 42 will vary depending upon which setting the roller 42 is configured to.

Second, the channels 36 on the stern segment 30 and intermediate segment 40 desirably include multiple trays 38 into which the rollers 42 can be situated. The stern segment 30 and the intermediate segment 40 can contain any reasonable number of trays 38 with the more trays 38 that are available further increasing the adjustability of the rollers 42.

Figure 12:
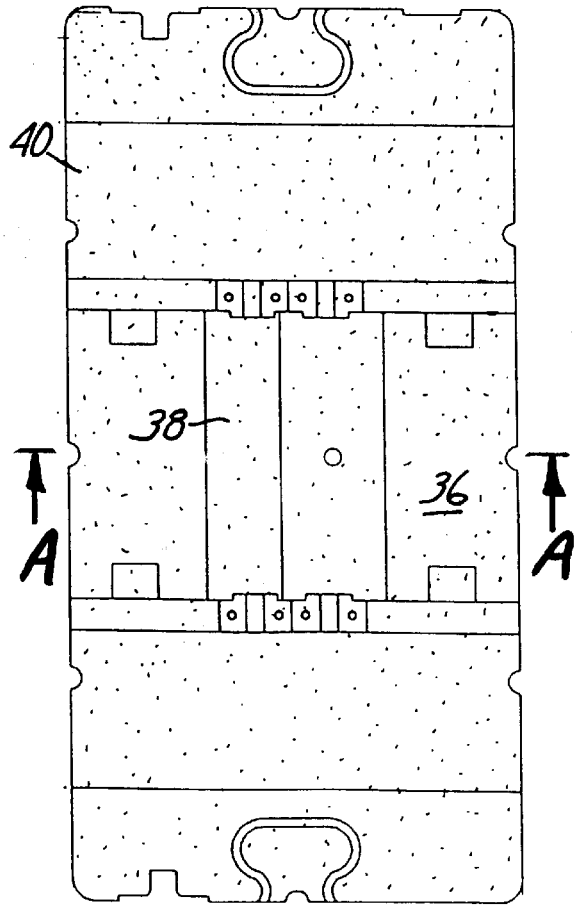
FIG. 12 is a top view of the intermediate segment of the invention.
Figure 14:
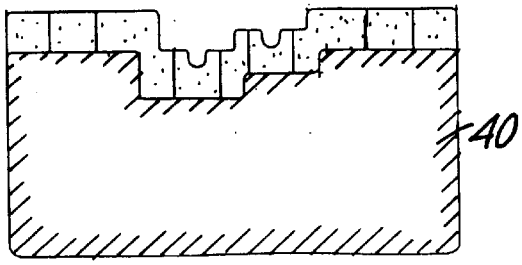
FIG. 14 is a cross sectional view of the intermediate segment of the invention taken along line A—A.
Figure 13:
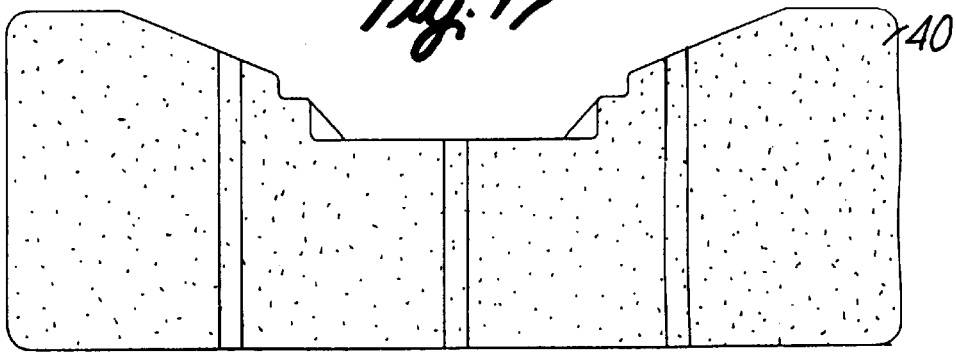
FIG. 13 is an end view of the intermediate segment of the invention.

As can be seen in FIGS. 12 and 16, in the preferred embodiment, the channels 36 contain two trays 38 that are available per roller 42. The trays 38 are positioned adjacent to each other with one tray 38 being situated at a slightly lower depth than the other tray 38.

The adjacent trays 38 allow the height of the rollers 42 to be easily adjusted by positioning the roller 42 in the desired tray 38. By varying the height of the rollers 42, the boat lift 10 is able to accommodate a wide variety of V-shaped hulls and position the craft so that the its hull is above the water line when docked.

As mentioned, in the preferred embodiment, the elongated roller 42 located at the end of the ramp section 34 of the stern segment 30 remains fixed while the remaining rollers 42 each have available to them a set of trays 38. Thus, the roller 42 on the intermediate segment 40 is adjustable to two different heights. The two non-fixed rollers 42 on the stern segment 30 are also each adjustable to two different heights. The combination of the four different settings of each roller 42 and the two different trays 38 for each roller 42 results in the rollers 42 being able to achieve multiple heights.

Thus, the present invention concerns a buoyant, modular boat lift capable of supporting V-hulled, and under certain circumstances, other types of boats. The boat lift is comprised of a pair of generally parallel buoyant docking members that are spaced laterally from each other. A bow stop and stern segment are releasably secured to the docking members so that they extend between the laterally spaced docking members. The bow stop defines a forward end of a boat receiving cavity and the stern segment is spaced proximally behind the bow stop. A support, such as a roller or belt, is included on the stern segment. The support tapers inwardly to receive the hull of a water vehicle and convey it to the receiving cavity. Intermediate segments can also be secured to the docking members between the bow stop and stern segment. The combined buoyancy of the docking members, bow stop and stern segment are sufficient to support the water vehicle above a surface of a body of water on which the boat lift rests.

In use, the boat lift is able to accommodate a wide variety of boats, including Jet-boats, bass boats, outboard and I/O runabouts. The boats can be boarded on the boat lift in a variety of fashions, such as drive-up, manual movement or winching.

The configuration of the boat lift 10 makes it easy to assemble and flexible in its applications and the environments in which it can be used. The molded polyethylene is rugged, virtually maintenance free and resistant to many of the detrimental factors associated with a water environment. Furthermore, the construction and configuration of the boat lift 10 allows it to be used in conditions where other boat lifts fail. For example, because it floats, the boat lift 10 of the present invention can be used where broad water level changes occur, where lake or river beds are soft, or where access makes it difficult to install other types of boat lifts.

To construct the boat lift 10, the appropriate docking members 12 are chosen and secured in the desired location of the boat lift 10. The bow stop 20, stern segment 30 and intermediate segments 40 are then secured to the docking members through the use of the anchors. The bow stop 20 is positioned between two docking members 12 at one end while the stern segment 30 is positioned at the end opposite the bow stop 20.

As mentioned, the types of docking members 12 and the number of intermediate segments 40 can be altered to accommodate crafts of different weights and length. The boat lift 10 is very flexible in its configurations. Listed below is a table showing some possible configurations of the boat lift 10 based upon the maximum weight of the boat to be docked. The configurations of the boat lift 10 referred to in the table are shown in FIG. 20.

| Configuration | Maximum Boat Weight (lbs) | Boat Length (ft) |
|---|---|---|
| A | 1500 | 12–14 |
| B | 1600 | 12–14 |
| C | 2100 | 12–14 |
| D | 2300 | 14–17 |
| E | 1700 | 16–18 |

-continued

| Configuration | Maximum Boat Weight (lbs) | Boat Length (ft) |
|---|---|---|
| F | 1800 | 16–18 |
| G | 2100 | 16–18 |
| H | 2300 | 16–18 |
| I | 2600 | 16–18 |
| J | 2500 | 17–19 |
| K | 2900 | 17–19 |

The rollers 42 on the stern segment 30 and intermediate segments 40 can also be adjusted to properly accommodate the desired boat hull. The height of the rollers 42 is varied by choosing one of the four available configurations and securing the rollers into the desired tray 38. The adjustability of the rollers 42 allows them to accommodate V-hull style boats with as little as 14° dead rise angle and as much as 21° dead rise angle.

Once the boat lift 10 is installed, boarding the boat lift 10 is similar to loading onto a roller bed trailer. The craft is first lined up with the stern segment 30. The craft can then be hooked up to the winch through the use of the strap. Finally, the winch is used to pull the craft onto the boat lift.

The ramp section 34 of the stern segment 30, together with the rollers 42 and the V-shaped depression assist in aligning the hull of the craft and guiding it into position on the boat lift 10. The other rollers 42 further aid in conveying the hull of the craft over the components of the boat lift 10. Furthermore, the bow stop 20 serves to prevent the hull of the craft from extending too far over the boat lift 10. Once docked, the craft is above the water level and can be secured in the appropriate fashion. Launching the craft is also easily accomplished by pushing the craft off of the boat lift 10.

While a preferred embodiment of the present invention has been described, it should be understood that various changes, adaptations and modifications may be made therein without departing from the spirit of the invention and the scope of the appended claims.

What is claimed is:

1. A buoyant, modular boat lift for supporting V-hulled boats, comprising:

a pair of generally parallel buoyant docking members spaced laterally from each other;

a bow stop releasably secured to the docking members so that it extends between the laterally spaced docking members and defining a forward end of a boat receiving cavity;

a stern segment releasably secured to the docking members so that it extends between the laterally spaced docking members and is spaced proximally behind the bow stop;

a support tapered inwardly to receive the hull of a water vehicle; and wherein the combined buoyancy of the docking members, bow stop and stern segment being sufficient to support a water vehicle above a surface of a body of water on which the boat lift rests.

2. The boat lift of claim 1 further comprising at least one intermediate segment containing at least one roller, the intermediate segment being positioned between the two docking members and between the bow stop and stern segment.

3. The boat lift of claim 2 wherein the bow stop, stern segment and intermediate segment are spaced a distance apart from each other so that a portion of the boat cavity is open to the body of water upon which the boat lift rests.

4. The boat lift of claim 3 wherein the stern segment and intermediate segment contain a channel for assisting the boat in boarding the boat lift.

5. The boat lift of claim 4 wherein supports are positioned within the channels.

6. The boat lift of claim 5 wherein the channels includes trays that spans the width of the channels, the supports being positioned within the trays.

7. The boat lift of claim 6 wherein the channels contains a plurality of trays for varying the height of the supports.

8. The boat lift of claim 1 wherein the bow stop and stern segment are spaced a distance apart from each other so that a portion of the boat cavity is open to the body of water upon which the boat lift rests.

9. The boat lift of claim 8 wherein the stern segment contains a channel for assisting the boat in boarding the boat lift.

10. The boat lift of claim 9 wherein the support is positioned within the channel.

11. The boat lift of claim 10 wherein the channel includes a tray that spans the width of the channel, the support being positioned within the tray.

12. The boat lift of claim 11 wherein the channel contains a plurality of trays for varying the height of the support.

13. A buoyant, modular boat lift for supporting V-hulled boats, comprising:

a pair of generally parallel buoyant docking members spaced laterally from each other;

a bow stop releasably secured to the docking members so that it extends between the laterally spaced docking members and defining a forward end of a boat receiving cavity;

a stern segment releasably secured to the docking members so that it extends between the laterally spaced docking members and is spaced proximally behind the bow stop;

wherein the combined buoyancy of the docking members, bow stop and stern segment being sufficient to support a water vehicle above a surface of a body of water on which the boat lift rests; and wherein the bow stop and stern segment are spaced a distance apart from each other so that a portion of the boat cavity is open to the body of water upon which the boat lift rests.

14. The boat lift of claim 13 wherein the bow stop, stern segment and intermediate segment are each formed to create a cavity.

15. The boat lift of claim 14 wherein portions of the bottom surface of the bow stop, stern segment and intermediate segment extend upwardly within the cavity towards the top surface of the bow stop, stern segment and intermediate segment to form tapered pylons.

16. The boat lift of claim 15 wherein the pylons have an arcuate top.

* * * * *